US008937616B2

(12) United States Patent
Yamazaki

(10) Patent No.: US 8,937,616 B2
(45) Date of Patent: Jan. 20, 2015

(54) ELECTRO-OPTICAL APPARATUS, METHOD FOR DRIVING ELECTRO-OPTICAL APPARATUS, APPARATUS FOR CONTROLLING ELECTRO-OPTICAL APPARATUS, AND ELECTRONIC APPARATUS

(75) Inventor: Katsunori Yamazaki, Matsumoto (JP)

(73) Assignee: Seiko Epson Corporation (JP)

( * ) Notice: Subject to any disclaimer, the term of this patent is extended or adjusted under 35 U.S.C. 154(b) by 333 days.

(21) Appl. No.: 13/419,727

(22) Filed: Mar. 14, 2012

(65) Prior Publication Data

US 2012/0235977 A1 Sep. 20, 2012

(30) Foreign Application Priority Data

Mar. 15, 2011 (JP) ..... 2011-056527

(51) Int. Cl.
*G09G 5/00* (2006.01)
*G09G 3/34* (2006.01)

(52) U.S. Cl.
CPC ..... *G09G 3/344* (2013.01); *G09G 2300/0814* (2013.01); *G09G 2300/0852* (2013.01); *G09G 2310/0262* (2013.01)
USPC ..... 345/212

(58) Field of Classification Search
None
See application file for complete search history.

(56) References Cited

U.S. PATENT DOCUMENTS 7,859,527 B2 12/2010 Hirota et al.
2007/0164938 A1* 7/2007 Shin et al. ..... 345/76
2008/0007816 A1 1/2008 Maeda
2008/0238867 A1 10/2008 Maeda et al.
2009/0096725 A1* 4/2009 Kretz et al. ..... 345/82
2009/0128527 A1* 5/2009 Itakura et al. ..... 345/205
2009/0190199 A1* 7/2009 Kasai ..... 359/245
2010/0073282 A1 3/2010 Murayama
2010/0253708 A1* 10/2010 Kasai ..... 345/690
2010/0253866 A1 10/2010 Lan et al.
2011/0181585 A1* 7/2011 Ozawa et al. ..... 345/213

FOREIGN PATENT DOCUMENTS

JP 2000-035775 2/2000
JP 2008-033241 2/2008
JP 2008-176330 7/2008
JP 2010-102299 A 5/2010
JP 2010-244007 A 10/2010
JP 2010-256919 11/2010

* cited by examiner

*Primary Examiner* — Adam R Giesy
*Assistant Examiner* — Henok Heyi
(74) *Attorney, Agent, or Firm* — Harness, Dickey & Pierce, P.L.C.

(57) ABSTRACT

When a first data line becomes an H level and a second data line becomes an L level at the time that a scan line is at the H level, a first TFT is turned on and a second TFT is turned off. When the first TFT is turned on, a voltage higher than the voltage of a common electrode is applied to a pixel electrode, so that a pixel is displayed in black. When the first data line becomes the L level and the second data line becomes the H level at the time that the scan line is at the H level, the first TFT is turned off and the second TFT is turned on. When the second TFT is turned on, a voltage lower than the voltage of the common electrode is applied to the pixel electrode, so that a pixel is displayed in white.

5 Claims, 9 Drawing Sheets

ELECTRO-OPTICAL APPARATUS, METHOD FOR DRIVING ELECTRO-OPTICAL APPARATUS, APPARATUS FOR CONTROLLING ELECTRO-OPTICAL APPARATUS, AND ELECTRONIC APPARATUS

BACKGROUND

1. Technical Field

The present invention relates to a technology for driving the pixels of an electro-optical apparatus.

2. Related Art

There is a driving circuit disclosed in JPA-2000-35775 as the driving circuit of a display apparatus using electrophoretic particles. The driving circuit includes switching segments each configured to include a dipolar switching element corresponding to the intersection of a row driving voltage line and a column selection line and a voltage holding capacity. When the dipolar switching element is turned on, voltage which was applied to the dipolar switching element is applied to the voltage holding capacity. The voltage held by the voltage holding capacity is applied to an output electrode which is connected to the voltage holding capacity. The output electrode corresponds to an electrode which applies electric field to a micro-capsule which has white and black particles. The particles in the micro-capsule move based on the voltage which was applied to the output electrode. Meanwhile, although the driving circuit disclosed in JP-A-2000-35775 has the configuration in which a single switching segment has a single switching element, there may be a configuration in which a memory circuit is provided for each pixel in order to hold a voltage which is applied to an electrode as in the driving circuits disclosed in JP-A-2008-33241 and JPA-2010-256919.

In the driving circuit disclosed in JP-A-2000-35775, when a dipolar switching element is turned off, a pixel is driven using charges stored in the voltage holding capacity. However, the voltage applied from the voltage holding capacity to the output electrode decreases as time elapses, with the result that a pixel is not fully driven by charging the voltage holding capacity once, so that it is necessary to charge the voltage holding capacity a plurality of times in order to fully drive a pixel. When the voltage holding capacity is charged a plurality of times, the voltage of a row driving voltage line and the voltage of a column selection line are variously changed. Since such a line has a parasitic capacity, power consumption increases if voltage changes a large number of times. Further, in the driving circuits disclosed in JP-A-2008-33241 and JP-A-2010-256919, a memory circuit is provide for each pixel, so that it is difficult to realize high-definition.

SUMMARY

An advantage of some aspects of the invention is to drive pixels using low power consumption.

According to an aspect of the invention, there is provided an electro-optical apparatus including a plurality of pixels each having charged particles between a first electrode and a second electrode which is paired with the first electrode. Each pixel includes a pixel circuit. The pixel circuit includes a first transistor, a second transistor, a third transistor, and a fourth transistor. The first electrode is connected to the drains of the first transistor and the second transistor. A predetermined first voltage is applied to the source of the first transistor. A predetermined second voltage is applied to a source of the second transistor. The gate of the first transistor is connected to the drain of the third transistor. The gate of the second transistor is connected to the drain of the fourth transistor. A state in which the first voltage or the second voltage is applied to the first electrode is made or the first electrode becomes a high impedance state using a signal which is supplied to the gate of the third transistor and the gate of the fourth transistor and using a signal which is supplied to the source of the third transistor and the source of the fourth transistor.

According to the aspect of the invention, the first voltage applied to the source of the first transistor or the second voltage applied to the source of the second transistor are continuously applied to the first electrode, so that a pixel can be driven using low power consumption.

It is preferable that a configuration may be made such that the pixel circuits are arranged in a matrix, a scan line is provided for each row of the pixel circuits, a first data line and a second data line are provided for each column of the pixel circuits, the gate of the third transistor and the gate of the fourth transistor of each pixel circuit are connected to the scan line corresponding to the relevant pixel circuit, and the source of the third transistor of the pixel circuit is connected to the first data line corresponding to the relevant pixel circuit, and the source of the fourth transistor of the pixel circuit is connected to the second data line corresponding to the relevant pixel circuit.

According to the aspect of the invention, a single scan line may be provided for each pixel circuit row, so that a pixel can be driven by making one of the first data line and the second data line an on-level and making the other one an off-level.

Further, it is preferable that a configuration may be made such that the pixel circuits are arranged in a matrix, a scan line is provided for each row of the pixel circuits, a data line is provided for each column of the pixel circuits, the gate of the third transistor of each pixel circuit is connected to a scan line corresponding to a relevant pixel circuit, a clock signal is supplied to the gate of the fourth transistor of the pixel circuit, the source of the third transistor of the pixel circuit is connected to the data line corresponding to the relevant pixel circuit, and the source of the fourth transistor of the pixel circuit is connected to the drain of the third transistor of the relevant pixel circuit.

According to the aspect of the invention, a single data line may be provided for each column of the pixel circuits, so that the number of data lines can be suppressed, thereby suppressing power consumption.

It is preferable that a configuration may be made such that the pixel circuits are arranged in a matrix, a first scan line and a second scan line are provide for each row of the pixel circuits, a data line is provided for each column of the pixel circuits, the gate of the third transistor of each pixel circuit is connected to the first scan line corresponding to a relevant pixel circuit, and the gate of the fourth transistor of the pixel circuit is connected to the second scan line corresponding to the relevant pixel circuit, and the source of the third transistor and the source of the fourth transistor of the pixel circuit are connected to the data line corresponding to the relevant pixel circuit.

According to the aspect of the invention, a single data line may be provided for each column of the pixel circuits, so that the number of data lines can be suppressed, thereby suppressing power consumption.

It is preferable that a configuration may be made such that the pixel circuits are arranged in a matrix, a first scan line and a second scan line are provided for each row of the pixel circuits, a data line is provided for each column of the pixel circuits, a fifth transistor and a sixth transistor are further provided for each row of the pixel circuits, the gate of the fifth transistor is connected to the first scan line of a row corresponding to the same, the gate of the sixth transistor is connected to the first scan line of the subsequent row of a row corresponding to the same, the drain of the fifth transistor and the drain of the sixth transistor are connected to the second scan line to which the gate of the fourth transistor of the corresponding pixel circuit is connected, a voltage, used to turn on the fourth transistor of the corresponding pixel circuit, is applied to the source of the fifth transistor of the pixel circuit, a voltage, used to turn off the fourth transistor of the corresponding pixel circuit, is applied to the source of the sixth transistor of the pixel circuit, the gate of the third transistor of the pixel circuit is connected to the first scan line corresponding to the corresponding pixel circuit, and the source of the third transistor of the pixel circuit and the source of the fourth transistor of the corresponding pixel circuit are connected to the data line corresponding to the corresponding pixel circuit.

According to the aspect of the invention, a single data line may be provided for each column of the pixel circuits, so that the number of data lines can be suppressed, thereby suppressing power consumption. Further, a voltage having a predetermined driving waveform may be supplied to only the first scan line, so that the configuration of the circuit becomes simple.

It is preferable that a configuration may be made such that a seventh transistor, an eighth transistor, and a ninth transistor are provided for each row of the pixel circuits, the gate of the seventh transistor for each row is connected to a scan line corresponding to a relevant row, the gate of the eighth transistor for each row is connected to a scan line corresponding to the subsequent row of the relevant row, a voltage, used to turn off the ninth transistor, is applied to a source of the seventh transistor, a voltage, used to turn on the ninth transistor, is applied to a source of the eighth transistor, the drain of the seventh transistor and the drain of the eighth transistor are connected to the gate of the ninth transistor, a first voltage is applied to the source of the ninth transistor, and the drain of the ninth transistor is connected to the source of the first transistor.

According to the aspect of the invention, the source of the first transistor becomes high impedance during a period that the scan line is selected, so that a line used to apply the first voltage and a line used to apply the second voltage do not short-circuit.

Further, according to another aspect of the invention, there is provided a method for driving an electro-optical apparatus including a plurality of pixels having charged particles between a first electrode and a second electrode which is paired with the first electrode, each pixel including a pixel circuit which drives such a pixel, the pixel circuit including a first transistor, a second transistor, a third transistor and a fourth transistor, the drains of the first transistor and the second transistor being connected to the first electrode, the gate of the first transistor being connected to a drain of the third transistor, and the gate of the second transistor being connected to a drain of the fourth transistor. A predetermined first voltage is applied to the source of the first transistor. A predetermined second voltage is applied to the source of the second transistor. A signal, used to turn on or turn off the corresponding third transistor, is supplied to the gate of the third transistor. A signal, used to turn on or turn off the corresponding fourth transistor, is supplied to the gate of the fourth transistor. An image signal, used to define the pixel display state, is supplied to the source of the third transistor and the source of the fourth transistor.

According to the aspect of the invention, the first voltage applied to the source of the first transistor or the second voltage applied to the source of the second transistor are continuously applied to the first electrode, so that a pixel can be driven using low power consumption.

Further, according to still another aspect of the invention, there is provided an apparatus for controlling an electro-optical apparatus including a plurality of pixels having charged particles between a first electrode and a second electrode which is paired with the first electrode, each pixel including a pixel circuit which drives such a pixel, the pixel circuit including a first transistor, a second transistor, a third transistor and a fourth transistor, the drains of the first transistor and the second transistor being connected to the first electrode, the gate of the first transistor being connected to a drain of the third transistor, and the gate of the second transistor being connected to a drain of the fourth transistor. A predetermined first voltage is applied to the source of the first transistor. A predetermined second voltage is applied to the source of the second transistor. A signal, used to turn on or turn off the corresponding third transistor, is supplied to the gate of the third transistor. A signal, used to turn on or turn off the corresponding fourth transistor, is supplied to the gate of the fourth transistor. An image signal, used to define the pixel display state, is supplied to the source of the third transistor and the source of the fourth transistor.

According to the aspect of the invention, the first voltage applied to the source of the first transistor or the second voltage applied to the source of the second transistor are continuously applied to the first electrode, so that a pixel can be driven using low power consumption.

Further, the invention is recognized as an electronic apparatus including the corresponding electro-optical apparatus in addition to the electro-optical apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Configuration of Embodiment

Figure 1:
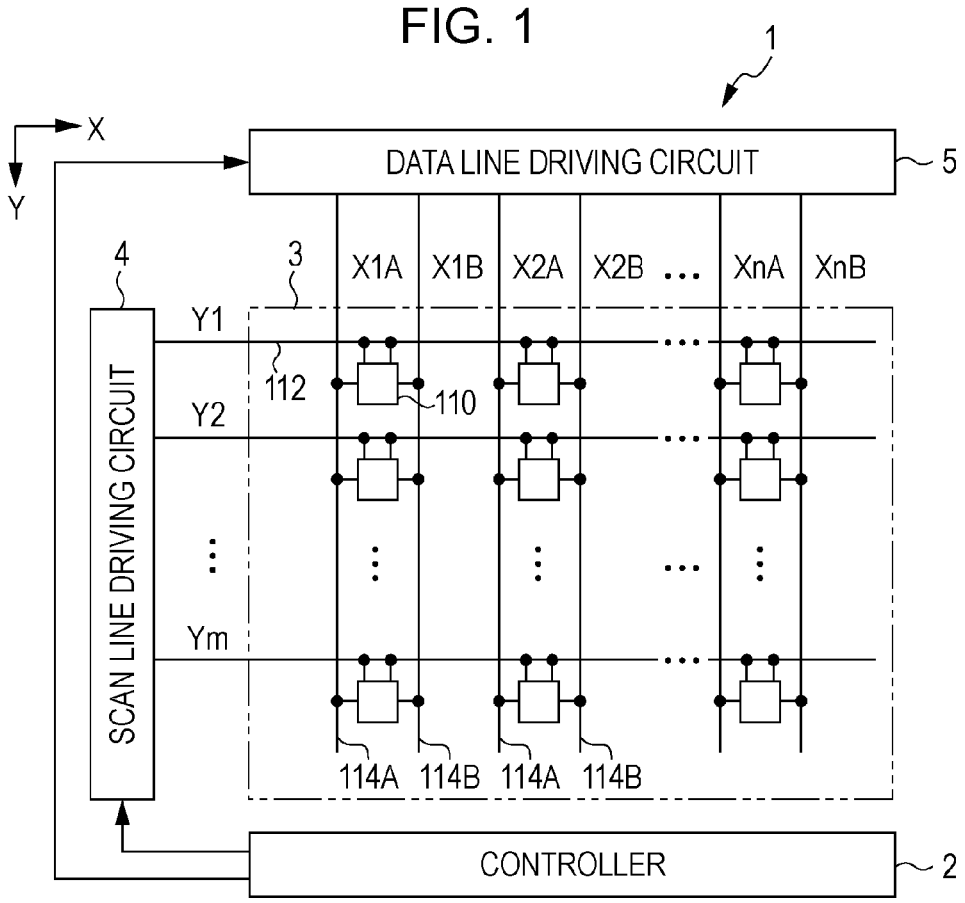
FIG. 1 is a view illustrating the configuration of an electro-optical apparatus according to a first embodiment.

FIG. 1 is a view illustrating the configuration of an electro-optical apparatus 1 according to a first embodiment of the invention. An electro-optical apparatus 1 includes a controller 2, a display unit 3, a scan line driving circuit 4, and a data line driving circuit 5. The controller 2 outputs various types of signals in order to drive pixels included in the display unit 3. The display unit 3 includes m row scan lines 112 in the row direction (X direction) and n column first data lines 114A and n column second data lines 114B in the column direction (Y direction). Further, along the row direction and the column direction, the display unit 3 includes m×n pixel circuits 110 in a matrix. A pixel circuit 110 is connected to a scan line 112, a first data line 114A, and a second data line 114B. For example, a pixel circuit 110 in a first row and a first column is connected to a scan line 112 in the first row, a first data line 114A in the first column, and a second data line 114B in the first column.

Figure 2:
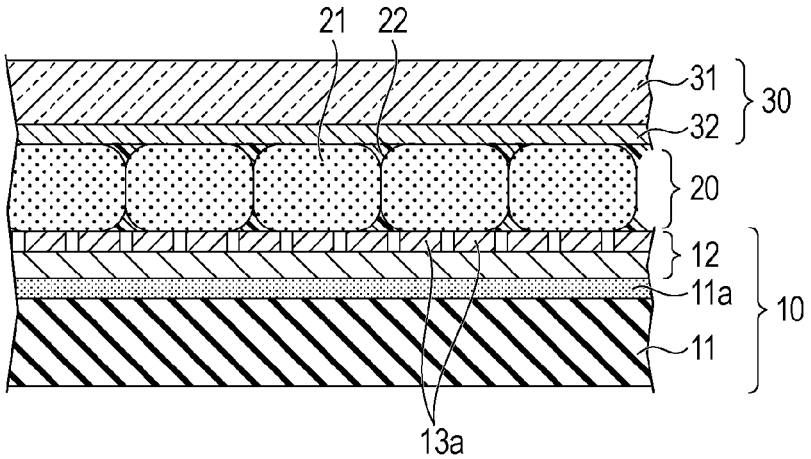
FIG. 2 is the partial cross sectional view of a display unit.

FIG. 2 is the partial cross sectional view of the display unit 3. The display unit 3 broadly includes a first substrate 10, an electrophoresis layer 20, and a second substrate 30 as shown in FIG. 2. The first substrate 10 is configured in such a way that a circuit layer is formed on a substrate 11 having insulating properties and flexibility. The substrate 11 is formed of polycarbonate according to the first embodiment. Further, in addition to the polycarbonate, resin material, which is light-weight and has flexibility, elasticity and insulating properties, may be used to form the substrate 11. Further, the substrate 11 may be formed of glass which does not have flexibility. An adhesion layer 11*a* is provided on the surface of the substrate 11, and a circuit layer 12 is laminated on the surface of the adhesion layer 11*a*. It is apparent that the circuit layer 12 may be directly formed on the substrate 11 without the adhesion layer 11*a* being interposed.

The circuit layer 12 includes a plurality of scan lines 112 arranged in the row direction and a plurality of first data lines 114A and a plurality of second data lines 114B which are provided to be electrically insulated with each of the scan lines 112 and arranged in the column direction. Further, the circuit layer 12 includes a pixel circuit 110 which is configured with Thin Film Transistors (TFTs) which correspond to switching elements, and a pixel electrode 13*a* (first electrode). The configuration of the pixel circuit 110 will be described later. Further, the polarities of a TFT include an n-channel and a p-channel. Although any of the polarities may be used, n-channel TFTs are used in the first embodiment.

The electrophoresis layer 20 includes a binder 22 and a plurality of micro-capsules 21 which are fixed by the binder 22, and the electrophoresis layer 20 is formed on the pixel electrode 13*a*. Further, an adhesion layer which is formed of an adhesive material may be provided between the micro-capsules 21 and the pixel electrode 13*a*.

Anything, which has excellent affinity with the micro-capsule 21 and has excellent adhesiveness with the electrode, may be used as the binder 22 without limit. A dispersing medium and electrophoretic particles are stored in such a micro-capsule 21. It is preferable that a material which has flexibility, such as a gum arabic gelatin-based compound or a urethane-based compound, may be used as a material which configures the micro-capsule 21.

As a dispersion medium, any one of water, an alcohol-based solvent (methanol, ethanol, isopropanol, butanol, octanol, or methylcellosolve), an esters (ethyl acetate or butyl acetate), a ketones (acetone, methyl ethyl ketone, or methyl isobutyl ketone), a linear aliphatic hydrocarbon (pentane, hexane, or octane), a cycloaliphatic hydrocarbon (cyclohexane or methylcyclohexane), an aromatic hydrocarbon (benzenes having a benzene group, a toluene group, and a long-chain alkyl group (xylene, hexylbenzene, heptylbenzene, octylbenzene, nonylbenzene, decylbenzene, undecylbenzene, dodecylbenzene, tridecylbenzene, or tetradecylbenzene)), a halogenated hydrocarbon (methylene chloride, chloroform, carbon tetrachloride, or 1,2-dichloroethane), or a carboxylic acid salt may be used. Further, the dispersion medium may be an oil or the like. Further, these substances as dispersion media may be used individually or as mixtures. Further, the dispersing medium may be composed of surfactants.

The electrophoretic particles correspond to particles (high molecules or colloids) which have a property of moving in the dispersing medium due to an electrical field. In the first embodiment, white electrophoretic particles and black electrophoretic particles are stored in the micro-capsule 21. Such a black electrophoretic particle corresponds to a particle which includes a black pigment, for example, aniline black or carbon black, and is positively charged in the first embodiment. Such a white electrophoretic particle corresponds to a particle which includes a white pigment, for example, titanium dioxide or aluminum oxide, and is negatively charged in the first embodiment.

The second substrate 30 includes a film 31 and a common electrode layer 32 (second electrode) which is formed on the bottom surface of the film 31. The film 31 performs the functions of sealing and protecting the electrophoresis layer 20, and corresponds to, for example, a polyethylene terephthalate film. The film 31 is transparent and has insulating properties. The common electrode layer 32 is formed of a transparent conducting layer, for example, an Indium Tin Oxide (ITO) film. Further, in the first embodiment, the side of a film 31 corresponds to the side from which a user views an image.

Returning to FIG. 1, the scan line driving circuit 4 is connected to each of the scan lines 112 of the display unit 3, and configured to supply scan signals Y1, Y2, . . . , and Ym to the scan lines 112 in the first, second, . . . , and m-th rows. In detail, the scan line driving circuit 4 selects the scan lines 112 in the order of the first, second, . . . , and m-th rows, supplies a signal at a high (H) level to a selected scan line 112, and supplies signals at a low (L) level to the scan lines 112 which were not selected.

The data line driving circuit 5 is connected to each of the first data lines 114A and second data lines 114B of the display unit 3, is configured to supply data signals X1A, X2A, . . . , and XnA to the first data lines 114A in the first, second, . . . , and n-th columns and supply data signals X1B, X2B, . . . , and XnB to the second data lines 114B in the first, second, . . . , and n-th columns in response to a signal supplied from the controller 2. Further, when the controller 2, the scan line driving circuit 4, and the data line driving circuit 5 are combined, they can be defined as the control device of the electro-optical apparatus 1.

Figure 3:
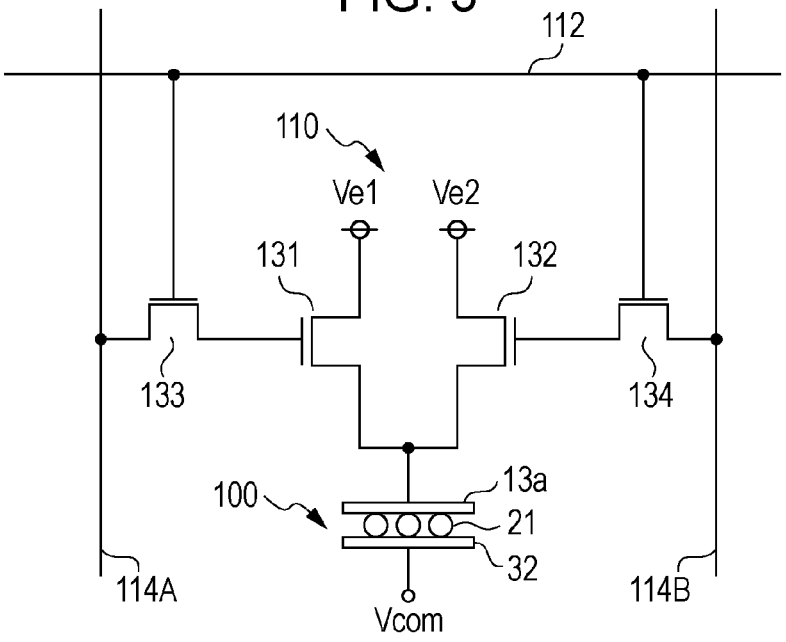
FIG. 3 is a view illustrating the configuration of a pixel circuit according to the first embodiment.

FIG. 3 is a view illustrating the configuration of the pixel circuit 110. Further, FIG. 3 shows a pixel circuit 110 in the first row and the first column. Since each pixel circuit 110 has the same configuration, the pixel circuit 110 in the first row and the first column will be explained as representative here, and the descriptions of other pixel circuits 110 will be omitted.

The pixel circuit 110 includes a TFT 131 (a first transistor), a TFT 132 (a second transistor), a TFT 133 (a third transistor), and a TFT 134 (a fourth transistor). The gate of the TFT 133 is connected to the scan line 112, and the source of the TFT 133 is connected to the first data line 114A. The gate of the TFT 134 is connected to the scan line 112, and the source of the TFT 134 is connected to the second data line 114B.

The gate of the TFT 131 is connected to the drain of the TFT 133, and a first voltage Ve1 is applied to the source of the TFT 131. The gate of the TFT 132 is connected to the drain of the TFT 134, and a second voltage Ve2 is applied to the source of the TFT 132. Further, the drain of the TFT 131 and the drain of the TFT 132 are connected to a pixel electrode 13*a*.

The pixel electrode 13*a* faces a common electrode layer 32, and the electrophoresis layer 20 is interposed between the pixel electrode 13*a* and the common electrode layer 32. The micro-capsules 21 which exist between the single pixel electrode 13*a* and the common electrode layer 32 become the single pixel 100 of the display unit 3.

Driving Method

Next, a driving method in the case where the pixel 100 is displayed in black and a driving method in the case where the pixel 100 is displayed in white will be described. When an image is displayed on the display unit 3 of the electro-optical apparatus 1, a voltage Vcom is applied to the common electrode layer 32. Here, the first voltage Ve1 is higher than the voltage Vcom, and the second voltage Ve2 is lower than the voltage Vcom.

Next, the controller 2 controls the scan line driving circuit 4, and sequentially selects the scan lines 112. For example, when the scan line 112 in the first row becomes an H level, the TFT 133 and the TFT 134 which have gates connected to the corresponding scan line 112 are turned on. Further, the controller 2 supplies an image signal, which is used to define the display state of the pixels 100 which exist in the same row as the scan line 112 selected by the scan line driving circuit 4, to the data line driving circuit 5. The data line driving circuit 5 supplies data signals to the first data line 114A and the second data line 114B in response to the supplied image signal.

For example, when the pixel 100 in the first row and the first column is displayed in black, the data line driving circuit 5 supplies a data signal X1B at an L level to the second data line 114B in the first column while supplying a data signal X1A at an H level to the first data line 114A in the first column. When the TFT 133 is turned on and the data line 114A becomes the H level, the gate of the TFT 131 becomes the H level, so that the TFT 131 is turned on. Further, when the TFT 134 is turned on and the data line 114B becomes the L level, the gate of the TFT 132 becomes the L level, so that the TFT 132 is turned off. When the TFT 131 is turned on and the TFT 132 is turned off, the first voltage Ve1 is applied to the pixel electrode 13*a*. Here, since the voltage of the pixel electrode 13*a* is higher than the voltage Vcom which is applied to the common electrode layer 32, black electrophoretic particles, which are positively charged, move to the side of a common electrode layer 32, and white electrophoretic particles, which are negatively charged, move to the side of a pixel electrode 13*a* in the electrophoresis layer 20.

Thereafter, when the scan line 112 becomes the L level, the TFT 133 and the TFT 134 are turned off. However, the voltage of the gate of the TFT 131 is maintained using the parasitic capacity between the gate of the TFT 131 and the drain of the TFT 133, and the voltage of the gate of the TFT 132 is maintained using the parasitic capacity between the gate of the TFT 132 and the drain of the TFT 134.

Therefore, even when the scan line 112 becomes the L level, the state in which the TFT 131 is turned on and the TFT 132 is turned off is maintained and the first voltage Ve1 is continuously applied to the pixel electrode 13*a*. When the first voltage Ve1 is continuously applied to the pixel electrode 13*a*, the black electrophoretic particles move to the side of common electrode layer 32 and the pixel 100 in the first row and the first column is displayed in black.

Thereafter, if the predetermined time elapses, the controller 2 controls the scan line driving circuit 4 and sequentially supplies the scan signals Y1, Y2, . . . , and Ym to the scan lines 112 again. Further, the controller 2 supplies a signal, which is used to make both the first data line 114A and the second data line 114B be at the L level, to the data line driving circuit 5. When the signal is supplied to the data line driving circuit 5, the data line driving circuit 5 makes the first data lines 114A and the second data lines 114B in the first to n-th columns to the L level.

When the data line 114A and the data line 114B become the L level while the scan line 112 is at the H level, the TFT 133 and the TFT 134 are turned off, and the TFT 131 and the TFT 132 are also turned off. When the TFT 131 and the TFT 132 are turned off, neither the first voltage Ve1 nor the second voltage Ve2 is applied to the pixel electrode 13*a*, so that the application of the voltage to the pixel electrode 13*a* is stopped. Even when the application of the voltage to the pixel electrode 13*a* is stopped, the black electrophoretic particles in the micro-capsule 21 maintain the state in which the black electrophoretic particles are pulled in the side of the common electrode layer 32, so that the pixel 100 in the first row and the first column is displayed in black.

Meanwhile, for example, when the pixel in the first row and the first column is displayed in white, the data line driving circuit 5 supplies the data signal X1A at the L level to the first data line 114A in the first column and supplies the data signal X1B at the H level to the second data line 114B in the first column during a period that the scan line 112 in the first row is at the H level. When the scan line 112 becomes the H level and the data line 114A becomes the L level while the TFT 133 is turned on, the gate of the TFT 131 becomes the L level, so that the TFT 131 is turned off. Further, when the scan line 112 becomes the H level and the data line 114B becomes the H level while the TFT 134 is turned on, the gate of the TFT 132 becomes the H level, so that the TFT 132 is turned on. When the TFT 131 is turned off and the TFT 132 is turned on, a second voltage Ve2 is applied to the pixel electrode 13*a*. Here, since the voltage of the pixel electrode 13*a* is lower than the voltage Vcom which is applied to the common electrode layer 32, the black electrophoretic particles, which are positively charged, move to the side of the pixel electrode 13*a* and the white electrophoretic particles, which are negatively charged, move to the side of the common electrode layer 32 in the electrophoresis layer 20.

Thereafter, when the scan line 112 becomes the L level, the TFT 133 and the TFT 134 are turned off. However, the voltage of the gate of the TFT 131 is maintained using the parasitic capacity between the gate of the TFT 131 and the drain of the TFT 133, so that the voltage of the gate of the TFT 132 is maintained using the parasitic capacity between the gate of the TFT 132 and the drain of the TFT 134. Therefore, even when the scan line 112 becomes the L level, the TFT 131 maintains the turned-off state and the TFT 132 maintains the turned-on state, so that the second voltage Ve2 is continuously applied to the pixel electrode 13*a*. When the second voltage Ve2 is continuously applied to the pixel electrode 13*a*, the white electrophoretic particles move to the common electrode layer 32, so that the pixel 100 in the first row and the first column is displayed in white.

Thereafter, when the predetermined time elapses, the data line 114A and the data line 114B become the L level during the period that the scan line 112 is at the H level, so that the TFT 131 and the TFT 132 are turned off as in the case where the pixel 100 was displayed in black. When the TFT 131 and the TFT 132 are turned off, neither the first voltage Ve1 nor the second voltage Ve2 is applied to the pixel electrode 13*a*, so that the application of voltage to the pixel electrode 13*a* is stopped. Even when the application of the voltage to the pixel electrode 13*a* is stopped, the white electrophoretic particles in the micro-capsule 21 maintain the state in which the white electrophoretic particles are pulled in the common electrode layer 32, so that the pixel 100 in the first row and the first column is displayed in white.

According to the first embodiment, voltage is applied to the pixel electrode 13*a* only once when the display of the pixel 100 is changed, so that power consumption can be suppressed. Further, according to the first embodiment, a voltage can be differently applied to the pixel electrode 13*a* for each pixel 100, so that a specific one of the pixels 100 in the same row can be changed to be displayed in black and the other pixels can be changed to be displayed in white by selecting the scan line 112 once. Further, according to the first embodiment, memory is not provided for each pixel, so that high-definition may be realized compared to a configuration in which a memory circuit is provided for each pixel.

Further, before performing the above-described driving in which both the TFT 131 and the TFT 132 are turned off after a predetermined time elapses and voltage is not applied to the pixel electrode 13*a*, the TFT 131 or the TFT 132 may be turned on in such a way that the first voltage Ve1 or the second voltage Ve2 is changed to voltage which is the same as the voltage Vcom. Therefore, the voltage of the pixel electrode 13*a* can be the same as the voltage Vcom, the movement of the electrophoretic particles can be securely stopped, so that the unevenness of display can be prevented. Further, the first voltage Ve1 and the second voltage Ve2 are changed to voltage which is the same as the voltage Vcom during a period that a rewriting operation is not performed, so that the movement of the electrophoretic particle can be prevented using leakage current obtained when the TFT 131 and the TFT 132 are turned off, thereby also preventing the unevenness of display.

Modification of First Embodiment

In the above-described first embodiment, the first data line 114A and the second data line 114B are provided for each column of the pixel circuit 110 from the data line driving circuit 5 and the data lines are connected to the data line driving circuit 5. However, a demultiplexer circuit may be provided between the data line driving circuit 5 and the display unit 3 in order to reduce the number of data lines which are connected to the data line driving circuit 5.

Figure 4:
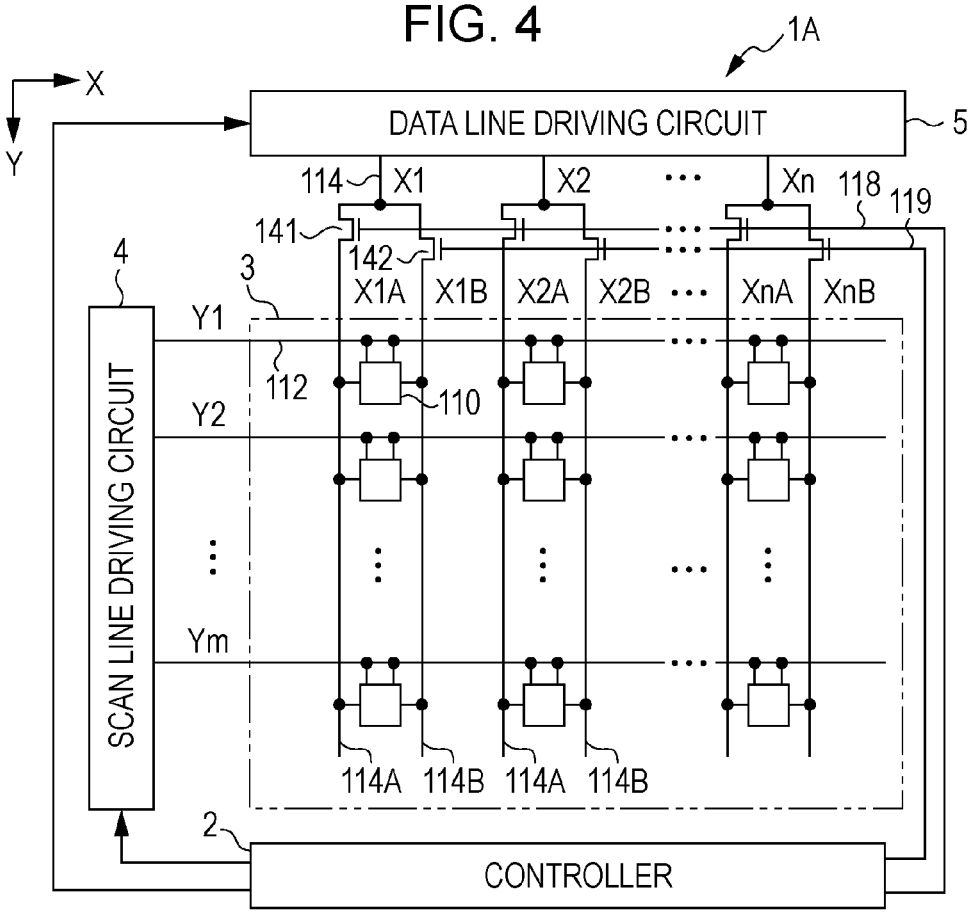
FIG. 4 is a view illustrating the configuration of an electro-optical apparatus according to the modification of the first embodiment.

FIG. 4 is a view illustrating the configuration of an electro-optical apparatus 1A according to the modification. N column data lines 114 are provided from the data line driving circuit 5 in the column direction. A TFT 141 and a TFT 142 are provided between the data line driving circuit 5 and the display unit 3 for each data line 114. The source of the TFT 141 is connected to the data line 114, and the drain of the TFT 141 is connected to the first data line 114A. Further, the source of the TFT 142 is connected to the data line 114, and the drain of the TFT 142 is connected to the second data line 114B. Further, the gate of the TFT 141 is connected to the first selection line 118, and the gate of the TFT 142 is connected to the second selection line 119.

Figure 5:
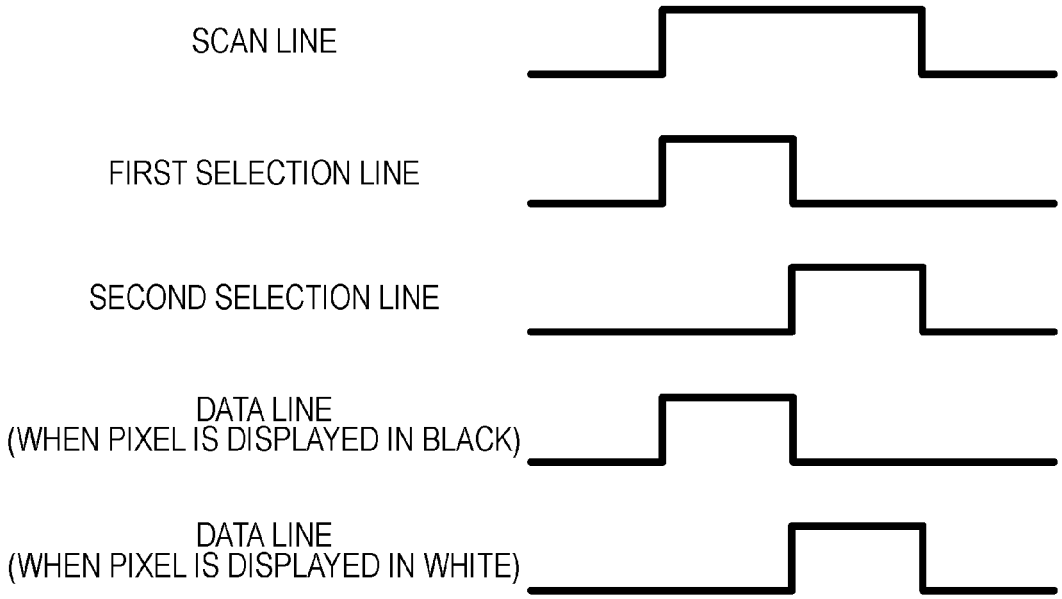
FIG. 5 is a view illustrating signals supplied to a first selection line and a second selection line.

FIG. 5 is a view illustrating the waveforms of signals supplied to a first selection line 118, a second selection line 119, a scan line 112 and a data line 114. The first selection line 118 is at an H level during a first half period that a scan signal supplied to the scan line 112 is at an H level and then is at an L level during a last half period. Further, the second selection line 119 is at an L level during the first half period that the scan signal supplied to the scan line 112 is at the H level and then is at an H level during the last half period.

When a pixel 100 which exists in the same column as the corresponding data line 114 is displayed in black, the data line 114 becomes the H level during the period that the first selection line 118 is at the H level, and then becomes the L level during the period that the second selection line 119 is at the H level. Further, when the pixel 100 which exists in the same column as the corresponding data line 114 is displayed in white, the data line 114 becomes the L level during the period that the first selection line 118 is at the H level, and then becomes the H level during the period that the second selection line 119 is at the H level.

When the first selection line 118 is at the H level and the second selection line 119 is at the L level, the TFT 141 is turned on and the TFT 142 is turned off. When the TFT 141 is turned on, the voltage of the data line 114A corresponds to the voltage of the data line 114. When the data line 114 is at the H level, the data line 114A becomes the H level. When the data line 114 is at the L level, the data line 114A becomes the L level. Thereafter, even when the TFT 141 is turned off and the data line 114A is at high impedance because the first selection line 118 becomes the L level, the first data line 114A includes a parasitic capacity, so that the data line 114A maintains electric potential obtained when the TFT 141 is turned on.

Thereafter, when the first selection line 118 becomes the L level and the second selection line 119 becomes the H level, the TFT 142 is turned on. When the TFT 142 is turned on, the voltage of the data line 114B corresponds to the voltage of the data line 114. When the data line 114 is at the H level, the data line 114B becomes the H level. When the data line 114 is at the L level, the data line 114B becomes the L level.

As described above, in the modification of the first embodiment, one of the data line 114A and the data line 114B can be at the H level and the remaining one can be at the L level as in the above-described first embodiment. Further, the number of data lines which are connected to the data line driving circuit 5 can be reduced, compared to the above-described first embodiment.

Figure 6:
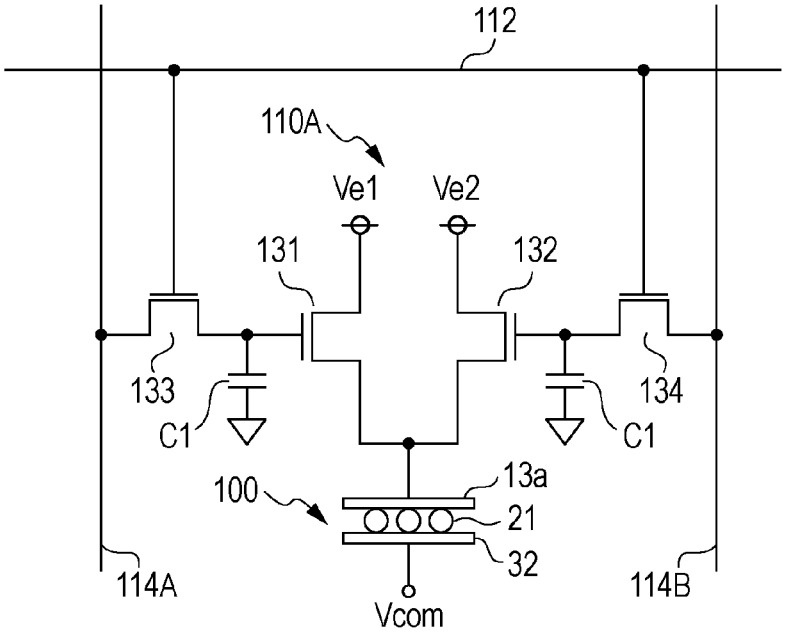
FIG. 6 is a view illustrating the configuration of a pixel circuit according to the modification of the first embodiment.

Next, another modification of the first embodiment will be described. FIG. 6 is a view illustrating the configuration of the pixel circuit 110A according to another modification of the first embodiment. As shown in FIG. 6, in the present modification, an auxiliary capacity C1 is connected between the gate of the TFT 131 and the drain of the TFT 133 and between the gate of the TFT 132 and the drain of the TFT 134.

In the above-described embodiment, after the TFT 133 and the TFT 134 are turned off, the TFT 131 operates using the parasitic capacity between the gate of the TFT 131 and the drain of the TFT 133 and the TFT 132 operates using the parasitic capacity between the gate of the TFT 132 and the drain of the TFT 134. Meanwhile, in the present modification, the electric potential between the gate of the TFT 131 and the drain of the TFT 133 and the electric potential between the gate of the TFT 132 and the drain of the TFT 134 are maintained by the auxiliary capacity C1, and the TFT 131 and the TFT 132 operate using the maintained voltage.

Second Embodiment

Next, a second embodiment of the invention will be described. When an electro-optical apparatus 1B according to the second embodiment is compared to the electro-optical apparatus 1 according to the first embodiment, the second embodiment has different configurations of the data lines which are connected to the data line driving circuit 5 and of the pixel circuits from those of the first embodiment, and other configurations are the same as those of the first embodiment. Therefore, the descriptions of the same configurations as those of the first embodiment will be omitted below, and the differences between the first and second embodiments will be mainly described.

Figure 7:
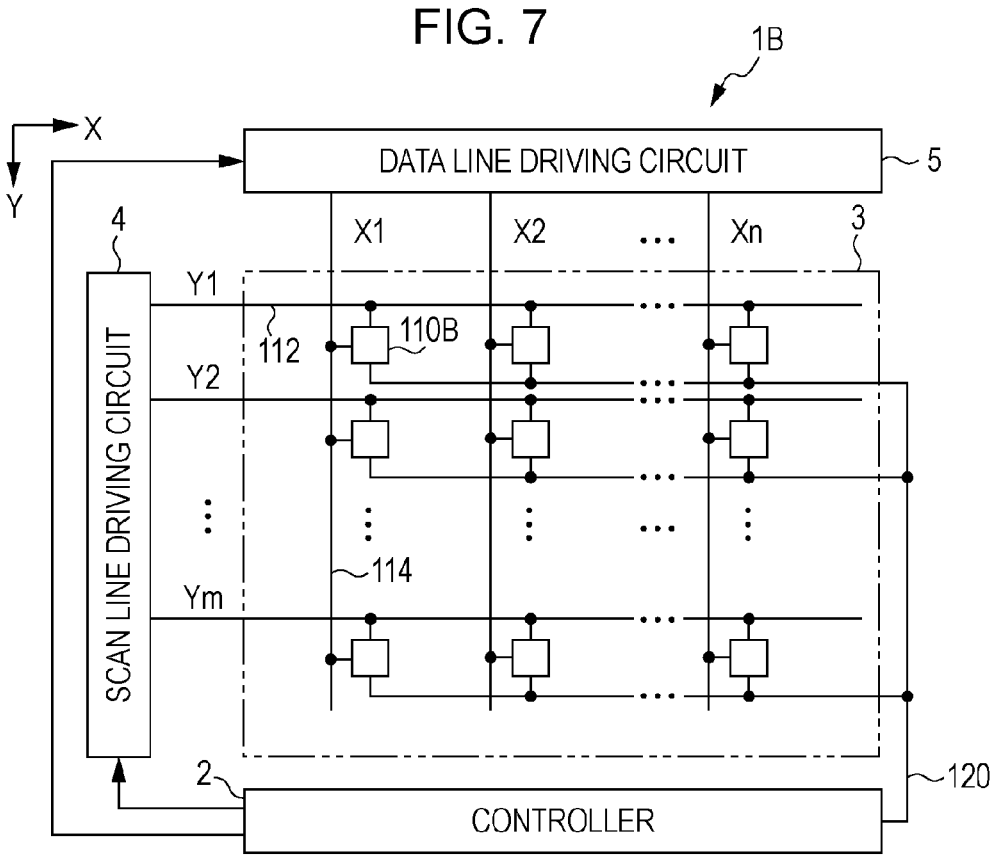
FIG. 7 is a view illustrating the configuration of an electro-optical apparatus according to a second embodiment.

FIG. 7 is a view illustrating the configuration of the electro-optical apparatus 1B according to the second embodiment. A display unit 3 according to the second embodiment is provided with n column data lines 114 in the column direction (Y direction). A single pixel circuit 110B is connected to a single scan line 112 and a single data line 114. For example, a pixel circuit 110B in the first row and the first column is connected to a scan line 112 in the first row and a data line 114 in the first column. That is, when viewed from the data lines, although a single pixel circuit 110 is connected to two data lines, that is, the first data line 114A and the second data line 114B, in the first embodiment, a single pixel circuit 110B is connected to a single data line 114 in the second embodiment. Further, the display unit 3 is provided with m row clock lines 120 in the row direction. The clock line 120 in each row is connected to the pixel circuits 110B in the same row.

Figure 8:
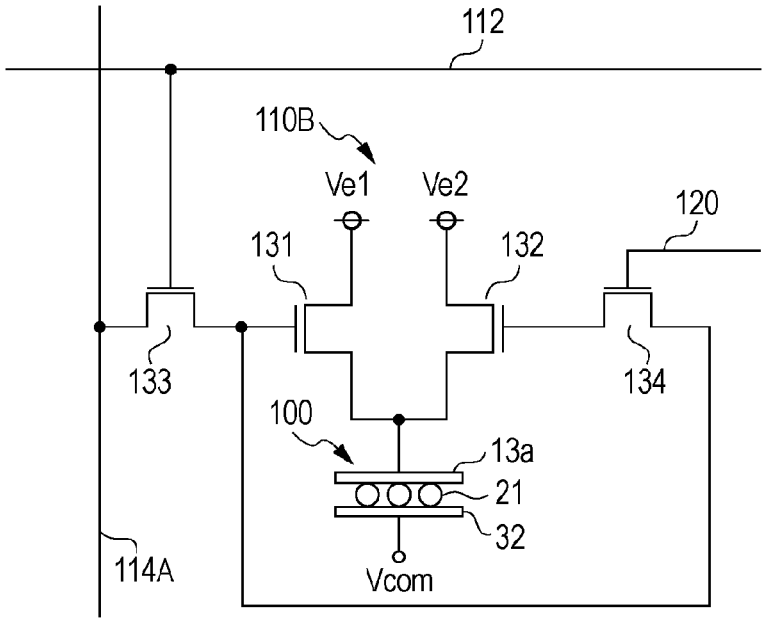
FIG. 8 is a view illustrating the configuration of a pixel circuit according to the second embodiment.

FIG. 8 is a view illustrating the configuration of the pixel circuit 110B according to the second embodiment. The pixel circuit 110B is different from the pixel circuit 110 of the first embodiment in that the gate of a TFT 134 is connected to a clock line 120, and the source of the TFT 134 is connected to the gate of a TFT 131.

Figure 9:
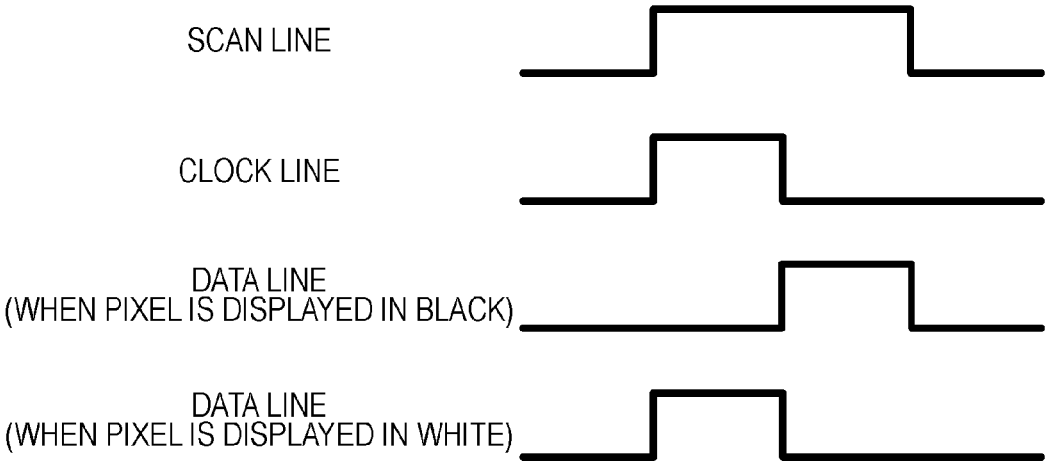
FIG. 9 is a view illustrating signals supplied to a clock line and a data line.

FIG. 9 is a view illustrating the waveforms of signals which are supplied to the scan line 112, the data line 114, and the clock line 120. A clock signal, which becomes an H level during a first half period that a scan signal supplied to the scan line 112 is at an H level and then becomes an L level during a last half period, is supplied to the clock line 120. When a pixel 100 which exists in the same column as the corresponding data line 114 is displayed in black, the data line 114 becomes the L level during a period that the scan line is at the H level and the clock line 120 is at the H level, and becomes the H level during a period that the clock line 120 is at the L level. Further, when the pixel 100 which exists in the same column as the corresponding data line 114 is displayed in white, the data line 114 becomes the H level during the period that the scan line is at the H level and the clock line 120 is at the H level, and becomes the L level during the period that the clock line 120 is at the L level.

When the clock line 120 becomes the H level during the first half period that the scan line 112 is at the H level, a TFT 133 which has a gate connected to the corresponding scan line 112 is turned on and a TFT 134 which has a gate connected to the clock line 120 is turned on. When the pixel 100 is displayed in black, the data line driving circuit 5 make the data line 114 the L level during the period that the clock line 120 is at the H level. When the data line 114 becomes the L level, the gate of the TFT 131 becomes the L level, so that the TFT 131 is turned off. Further, when the data line 114 becomes the L level, the source of the TFT 134 becomes the L level and the gate of the TFT 132 becomes the L level, so that a TFT 132 is turned off. Since the TFT 131 and the TFT 132 are turned off, the pixel electrode 13*a* becomes high impedance.

Next, during the last half period that the scan line 112 is at the H level, the clock line 120 becomes the L level and the data line 114 becomes the H level. When the clock line 120 becomes the L level, the gate of the TFT 134 becomes the L level and the TFT 134 is turned off, so that the gate of the TFT 132 becomes the high impedance state. Here, since the gate of the TFT 132 maintains L level state which is previous to the high impedance state using the parasitic capacity between the drain of the TFT 134 and the gate of the TFT 132, the TFT 132 maintains the turned-off state. Meanwhile, the drain of the TFT 131 becomes the H level because the data line 114 becomes the H level, so that the gate of the TFT 131 becomes the H level. When the gate of the TFT 131 becomes the H level, the TFT 131 is turned on, so that a first voltage Ve1 is applied to the pixel electrode 13*a*.

Here, since the voltage of the pixel electrode 13*a* becomes the first voltage Ve1 which is higher than the voltage of the common electrode layer 32, the black electrophoretic particles which are positively charged move to the side of the common electrode layer 32 and the white electrophoretic particles which are negatively charged move to the side of the pixel electrode 13*a* in the electrophoresis layer 20. Thereafter, as in the first embodiment, when the scan line 112 becomes the L level and a predetermined time elapses, the data line driving circuit 5 causes the data line 114 to be the L level and the TFT 131 and the TFT 132 to be turned off during the period that the scan line 112 is at the H level. Even when the application of voltage to the pixel electrode 13*a* is stopped, the black electrophoretic particles in the micro-capsule 21 maintain the state in which the black electrophoretic particles are pulled in the side of the common electrode layer 32, so that the pixel 100 is displayed in black.

Meanwhile, when the pixel 100 is displayed in white, the data line 114 becomes the H level during the period that the clock line 120 is at the H level. When the data line 114 becomes the H level, the gate of the TFT 131 becomes the H level, so that the TFT 131 is turned on. Further, when the data line 114 becomes the H level, the source of the TFT 134 becomes the H level and the gate of the TFT 132 becomes the H level, so that the TFT 132 is turned on.

Next, during the last half period that the scan line 112 is at the H level, the clock line 120 becomes the L level and the data line 114 becomes the L level. When the clock line 120 becomes the L level, the gate of the TFT 134 becomes the L level, with the result that the TFT 134 is turned off, so that the gate of the TFT 132 becomes the high impedance state. Here, since the gate of the TFT 132 maintains the H level state which is previous to the high impedance state using the parasitic capacity between the drain of the TFT 134 and the gate of the TFT 132, the TFT 132 maintains the turned-on state. Meanwhile, the drain of the TFT 131 becomes the L level because the data line 114 becomes the L level, so that the gate of the TFT 131 becomes the L level. When the gate of the TFT 131 becomes the L level, the TFT 131 is turned off, so that the second voltage Ve2 is applied to the pixel electrode 13*a*.

Here, since the voltage of the pixel electrode 13*a* becomes the second voltage Ve2 which is lower than the voltage of the common electrode layer 32, the black electrophoretic particles which are positively charged move to the side of the pixel electrode 13*a* and the white electrophoretic particles which are negatively charged move to the common electrode layer 32 in the electrophoresis layer 20. Thereafter, as in the first embodiment, when the scan line 112 becomes the L level and a predetermined time elapses, the data line 114 becomes the L level during the period that the scan line is at the H level, so that the TFT 131 and the TFT 132 are turned off. Even when the application of voltage to the pixel electrode 13*a* is stopped, the white electrophoretic particles in the micro-capsule 21 maintain the state in which the white electrophoretic particles are pulled in the side of the common electrode layer 32, so that the pixel 100 in the first row and the first column is displayed in white.

According to the second embodiment, a single data line 114 is provided to each column of the pixels 100, so that the number of data lines which are connected to the data line driving circuit 5 can be reduced compared to the first embodiment.

Modification of Second Embodiment

In the above-described second embodiment, the TFT 131 and the TFT 132 are turned on at the same time, so that a line used to apply voltage to the source of the TFT 131 and a line used to apply voltage to the source of the TFT 132 may short circuit. Here, a circuit shown in FIG. 10 may be provided for each row of pixels such that the TFT 131 and the TFT 132 are not turned on at the same time.

Figure 10:
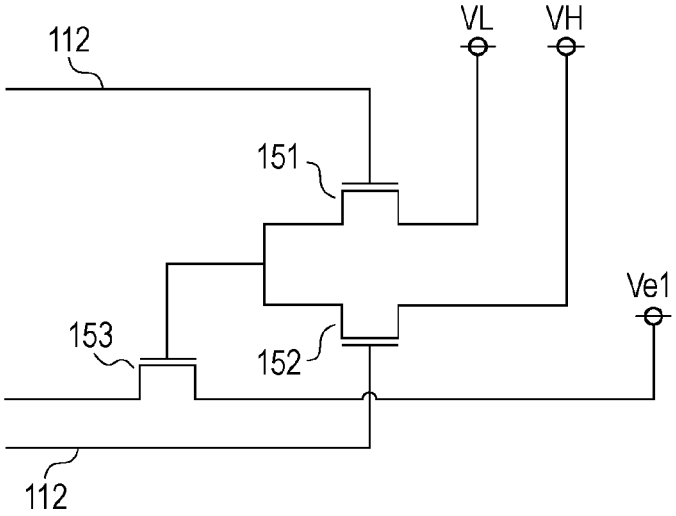
FIG. 10 is a view illustrating the configuration of a circuit according to the modification of the second embodiment.

The circuit shown in FIG. 10 is provided to correspond to each row of the pixel circuits 110, and configured to include a TFT 151 (seventh transistor), a TFT 152 (eighth transistor), and a TFT 153 (ninth transistor). The gate of the TFT 151 is connected to an i-th row scan line 112, and the gate of the TFT 152 is connected to an (i+1)-th row scan line 112. For example, when the circuit shown in FIG. 10 corresponds to the first row pixel circuit 110, the gate of the TFT 151 is connected to the first row scan line 112 and the gate of the TFT 152 is connected to the second row scan line 112. Further, when the circuit shown in FIG. 10 corresponds to an m-th row pixel circuit 110, the gate of the TFT 151 is connected to an m-th row scan line and the gate of the TFT 152 is connected to the first row scan line.

Further, a voltage VL used to turn off the TFT 153 is applied to the source of the TFT 151, and a voltage VH used to turn on the TFT 153 is applied to the source of the TFT 152. The drain of the TFT 151 and the drain of the TFT 152 are connected to the gate of the TFT 153. The first voltage Ve1 is applied to the source of the TFT 153, and the drain of the TFT 153 is connected to the source of the TFT 131 of the i-th row pixel circuit 110.

Further, the gate of the TFT 153 may be connected to the auxiliary capacity C1.

In such a configuration, for example, when the i-th row scan line 112 becomes the H level, the TFT 151 is turned on. Meanwhile, since the scan signals Y1, Y2, . . . , and Ym which are supplied to the respective scan lines 112 become the H level sequentially and exclusively, the (i+1)-th row scan line 112 is at the L level during the period that the i-th row scan line 112 is at the H level. Here, the TFT 151 is turned on and the TFT 152 is turned off, so that the voltage of the gate of the TFT 153 becomes the voltage VL. Since the TFT 153 is turned off and the source of the TFT 131 of the i-th row pixel circuit 110, the source of the TFT 131 becomes the high impedance state. Therefore, during the period that the i-th row scan line 112 is at the H level, a line used to apply voltage to the source of the TFT 131 of the i-th row pixel circuit 110 and a line used to apply voltage to the source of the TFT 132 of the i-th row pixel circuit 110 do not short circuit.

Next, when the i-th row scan line 112 is at the L level and the (i+1)-th row scan line 112 is at the H level, the TFT 151 is turned off and the TFT 152 is turned on, so that a voltage VH is applied to the gate of the TFT 153. Here, the TFT 153 is turned on, so that the first voltage Ve1 is applied to the source of the TFT 131 of the i-th row pixel circuit 110.

Thereafter, when the i-th row and (i+1)-th row scan lines 112 become the L level, the TFT 151 and the TFT 152 are turned off. Here, although the gate of the TFT 153 becomes the high impedance state, the gate of the TFT 153 maintains the voltage VH and the TFT 153 maintains the turned-on state using the parasitic capacity between the gate of the TFT 153 and the drains of the TFT 151 and the TFT 152, so that the first voltage Ve1 is continuously applied to the source of the TFT 131 of the i-th row pixel circuit 110.

According to the modification of the second embodiment, in the pixel circuit 110 of the row corresponding to the selected scan line 112, the source of the TFT 131 becomes high impedance, so that a line used to apply the first voltage Ve1 to the source of the TFT 131 and a line used to apply the second voltage Ve2 to the source of the TFT 132 do not short circuit in the pixel circuit 110 corresponding to the selected scan line 112.

Meanwhile, although configuration is made such that the first voltage Ve1 is applied to the gate of the TFT 153 and the drain of the TFT 153 is connected to the source of the TFT 131 in the above description, configuration may be made such that the second voltage Ve2 is applied to the gate of the TFT 153 and the drain of the TFT 153 is connected to the source of the TFT 132. Further, two circuits of FIG. 10 may be provided for each row such that the first voltage Ve1 is applied to the source of the TFT 153 of a first circuit and the drain of the TFT 153 is connected to the source of the TFT 131 while the second voltage Ve2 is applied to the source of the TFT 153 of a second circuit and the drain of the TFT 153 is connected to the source of the TFT 132.

Third Embodiment

Next, a third embodiment of the invention will be described. When an electro-optical apparatus 1C according to the third embodiment is compared to the electro-optical apparatus according to the first embodiment, the third embodiment has different configurations of the data lines, which are connected to the data line driving circuit 5, scan lines which are connected to the pixel circuits, and the pixel circuits from those of the first embodiment, and other configurations are the same as those of the first embodiment. Therefore, the description of the same configurations as those of the first embodiment will be omitted below, and differences between the first and third embodiments will be mainly described.

Figure 11:
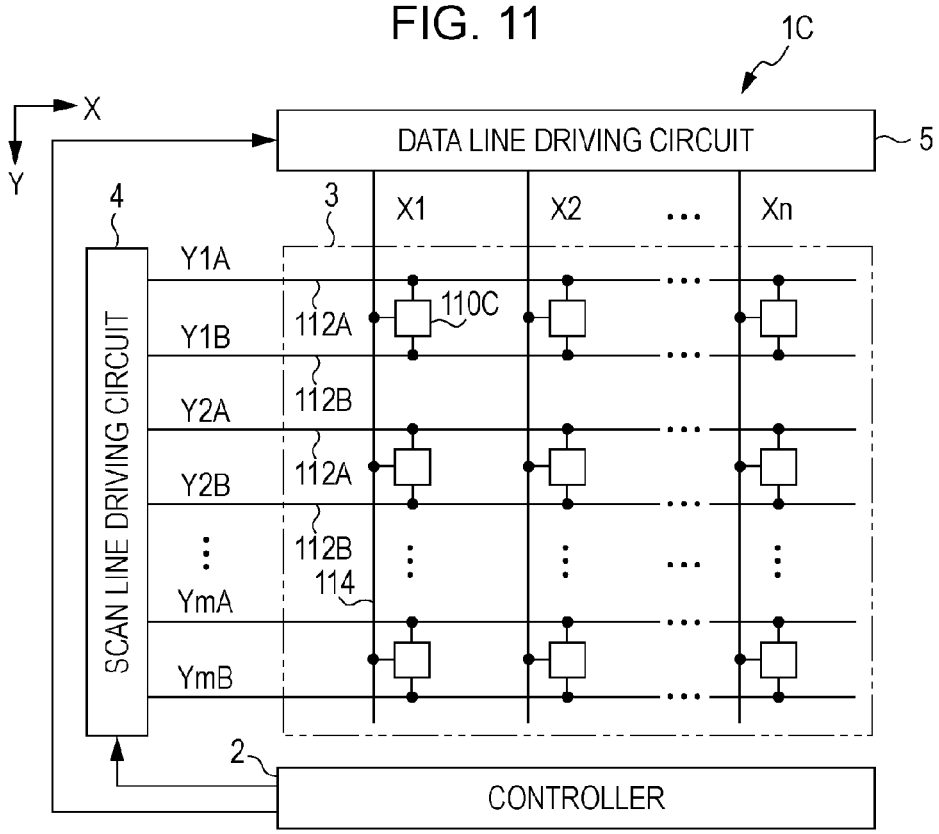
FIG. 11 is a view illustrating the configuration of an electro-optical apparatus according to a third embodiment.

FIG. 11 is a view illustrating the configuration of the electro-optical apparatus 1C according to the third embodiment. A display unit 3 according to the third embodiment is provided with n column data lines 114 in the column direction (Y direction) and m row first scan lines 112A and m row second scan lines 112B in the row direction (X direction). A single pixel circuit 110C is connected to a single first scan line 112A, a single second scan line 112B, and a single data line 114. For example, the pixel circuit 110C in the first row and the first column is connected to a first scan line 112A in a first row, a second scan line 112B in the first row and a data line 114 in a first column.

Figure 12:
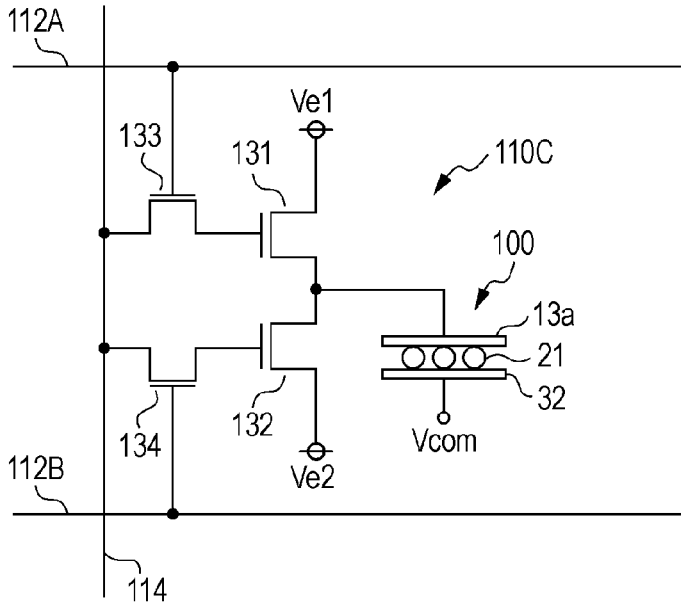
FIG. 12 is a view illustrating the configuration of a pixel circuit according to the third embodiment.

FIG. 12 is a view illustrating the configuration of the pixel circuit 110C according to the third embodiment. Since the configuration of each pixel circuit 110C is the same, the pixel circuit 110C in the first row and the first column will be described as representative, and the description of other pixel circuits 110C will be omitted.

In the pixel circuit 110C, the gate of a TFT 133 is connected to a scan line 112A, and the source of the TFT 133 is connected to a data line 114. The gate of a TFT 134 is connected to a scan line 112B and the source of the TFT 134 is connected to the data line 114. The gate of a TFT 131 is connected to the drain of the TFT 133 and a first voltage Ve1 is applied to the source of the TFT 131. The gate of the TFT 132 is connected to the drain of the TFT 134 and a second voltage Ve2 is applied to the source of the TFT 132. Further, the drain of the TFT 131 and the drain of the TFT 132 are connected to a pixel electrode 13*a*.

Driving Method

Next, a driving method in the case where a pixel 100 is displayed in black and a driving method in the case where the pixel 100 is displayed in white according to the third embodiment will be described. First, a controller 2 controls a scan line driving circuit 4 such that the scan line 112A and the scan line 112B are selected sequentially and exclusively.

Figure 13:
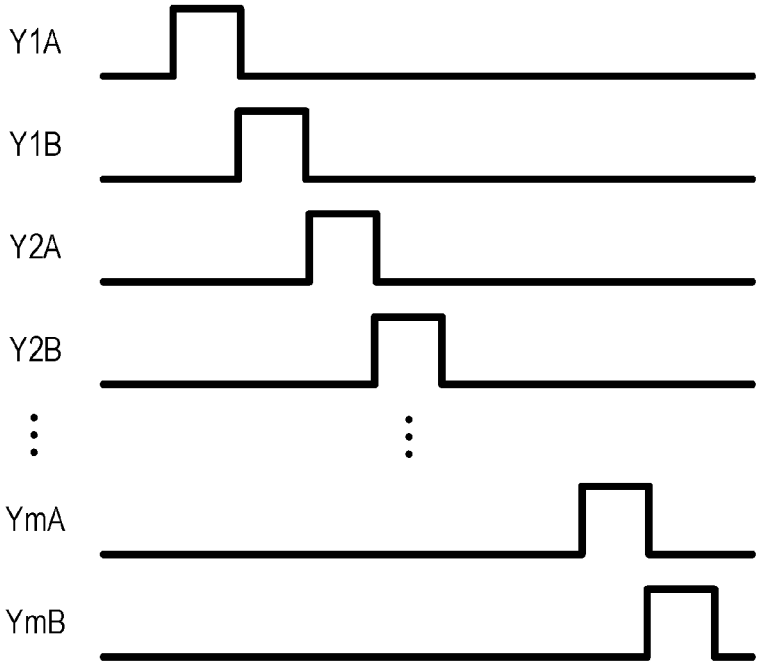
FIG. 13 is a view illustrating signals supplied to respective scan lines according to the third embodiment.

FIG. 13 is a view illustrating signals which are supplied to the respective scan lines. In a single row, the scan line 112B becomes an L level during a period that the scan line 112A is at an H level. When the scan line 112A becomes the L level, the scan line 112B in the same row then becomes the H level.

The controller 2 supplies an image signal, used to define the display state of the pixel 100 which exists in the same row selected by the scan line driving circuit 4, to the data line driving circuit 5. The data line driving circuit 5 supplies a data signal to the data line 114 in response to the supplied image signal. For example, when a pixel 100 in a first column is displayed in black, the data line 114 becomes the H level during a period that the scan line 112A is at the H level and the data line 114 becomes the L level during a period that the scan line 112B is at the H level.

When the first scan line 112A becomes the H level, the TFT 133 is turned on. Here, when the pixel 100 is displayed in black, the voltage of the data line 114 is at the H level, so that the TFT 131 is turned on and the first voltage Ve1 is applied to the pixel electrode 13*a*. Meanwhile, when the first scan line 112A is at the H level, the second scan line 112B is at the L level, so that the TFT 134 and the TFT 132 are turned off and the second voltage Ve2 is not applied to the pixel electrode 13*a*.

Next, when the first scan line 112A becomes the L level and the second scan line 112B becomes the H level, the TFT 133 is turned off and the TFT 134 is turned on. Here, when the pixel 100 is displayed in black, the voltage of the data line 114 is at the L level, so that the TFT 132 is turned off and the second voltage Ve2 is not applied to the pixel electrode 13*a*.

Thereafter, when the first scan line 112A and the second scan line 112B become the L level, the TFT 133 and the TFT 134 are turned off. Meanwhile, since the voltage of the gate of the TFT 131 is maintained using the parasitic capacity between the gate of the TFT 131 and the drain of the TFT 133, TFT 131 maintains the turned-on state and the first voltage Ve1 is continuously applied to the pixel electrode 13*a* even when the scan line 112A becomes the L level. When the first voltage Ve1 is continuously applied to the pixel electrode 13*a*, the black electrophoretic particles move to the side of a common electrode layer 32 and the pixel 100 is displayed in black.

Further, when the pixel 100 in the first column is displayed in white, the data line 114 becomes the L level during the period that the first scan line 112A is at the H level, and then becomes the H level during a period that the second scan line 112B is at the H level. When the first scan line 112A becomes the H level, the TFT 133 is turned on. Here, since the voltage of the data line 114 is at the L level, the TFT 131 is turned off and the first voltage Ve1 is not applied to the pixel electrode 13*a*. Next, when the second scan line 112B becomes the H level, the TFT 133 is turned off and the TFT 134 is turned on. Here, since the voltage of the data line 114 is at the H level, the TFT 132 is turned on and the second voltage Ve2 is applied to the pixel electrode 13*a*.

Thereafter, when voltage of the first scan line 112A and the voltage of the second scan line 112B become the L level, the TFT 133 and the TFT 134 are turned off. Meanwhile, since the voltage of the gate of the TFT 132 is maintained using the parasitic capacity between the gate of the TFT 132 and the drain of the TFT 134, the TFT 132 maintains the turned-on state and the second voltage Ve2 is applied to the pixel electrode 13*a* even when the scan line 112B becomes the L level. When the second voltage Ve2 is applied to the pixel electrode 13*a*, the white electrophoretic particles move to the side of the common electrode layer 32, so that the pixel 100 is displayed in white.

According to the third embodiment, voltage is applied to the pixel electrode 13*a* once when the display of the pixel 100 is changed, so that power consumption can be suppressed. Further, according to the third embodiment, voltage can be differently applied to the pixel electrode 13*a* for each pixel 100, so that a specific one of the pixels 100 in the same row can be changed to be displayed in black and the other pixels can be changed to be displayed in white by selecting the scan line 112 once. Further, according to the third embodiment, memory is not provided for each pixel, so that high-definition may be realized compared to a configuration in which a memory circuit is provided for each pixel.

Modification of Third Embodiment

Figure 14:
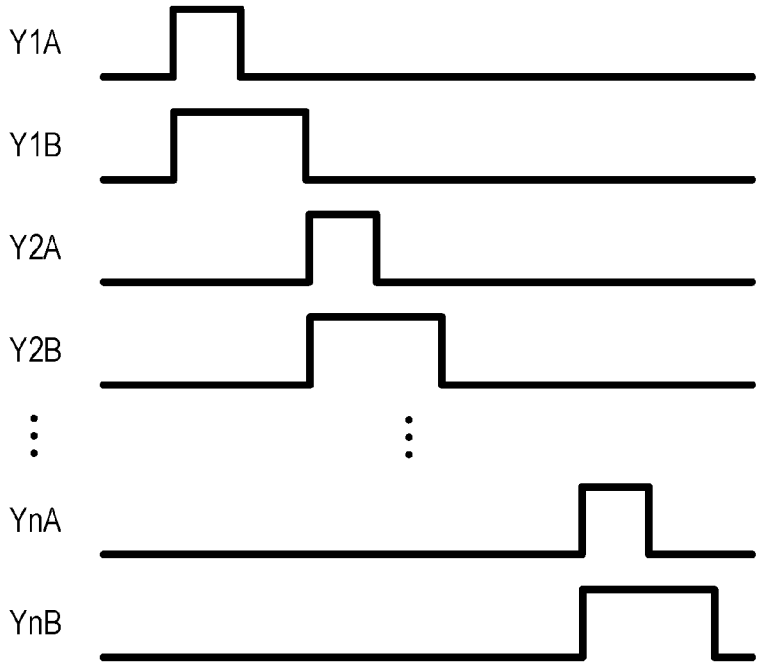
FIG. 14 is a view illustrating signals supplied to respective scan lines according to the modification of the third embodiment.

Although the first scan line 112A and the second scan line 112B become the H level sequentially and exclusively in the above-described third embodiment, the first scan line 112A and the second scan line 112B may become the H level at the same time such that the first scan line 112A becomes the L level after a predetermined time elapses, and then the second scan line 112B becomes the L level after an additional predetermined time elapses as shown in FIG. 14.

When the first scan line 112A and the second scan line 112B become the H level, the TFT 133 and the TFT 134 are turned on. Here, when the data line 114 is at the H level in order to display the pixel 100 in black, the TFT 131 and the TFT 132 are turned on. Thereafter, although the second scan line 112B maintains the H level, the first scan line 112A becomes the L level, so that the TFT 133 is turned off and the TFT 134 maintains the turned-on state. Here, when the data line 114 becomes the L level in order to display the pixel 100 in black, the TFT 132 is turned off. The gate of the TFT 131 maintains the H level using the parasitic capacity between the gate of the TFT 131 and the drain of the TFT 133, so that the TFT 131 maintains the turned-on state and the first voltage Ve1 is applied to the pixel electrode 13*a*, thereby displaying the pixel 100 in black.

Further, it is assumed that the first scan line 112A and the second scan line 112B become the H level such that the TFT 133 and the TFT 134 are turned on. When the data line 114 becomes the L level in order to display the pixel 100 in white, the TFT 131 and the TFT 132 are turned off. Thereafter, although the second scan line 112B maintains the H level, the first scan line 112A becomes the L level, so that the TFT 133 is turned off and the TFT 134 maintains the turned-on state. Here, when the data line 114 becomes the H level in order to display the pixel 100 in white, the TFT 132 is turned on. When the TFT 132 is turned on, the second voltage Ve2 is applied to the pixel electrode 13*a* and the pixel 100 is displayed in white.

Meanwhile, when the second scan line 112B becomes the L level thereafter, the TFT 133 is turned off. However, the gate of the TFT 134 maintains the H level using the parasitic capacity between the gate of the TFT 132 and the drain of the TFT 134, so that the TFT 132 maintains the turned-on state and the second voltage Ve2 is applied to the pixel electrode 13*a*, thereby displaying the pixel 100 in white.

Figure 15:
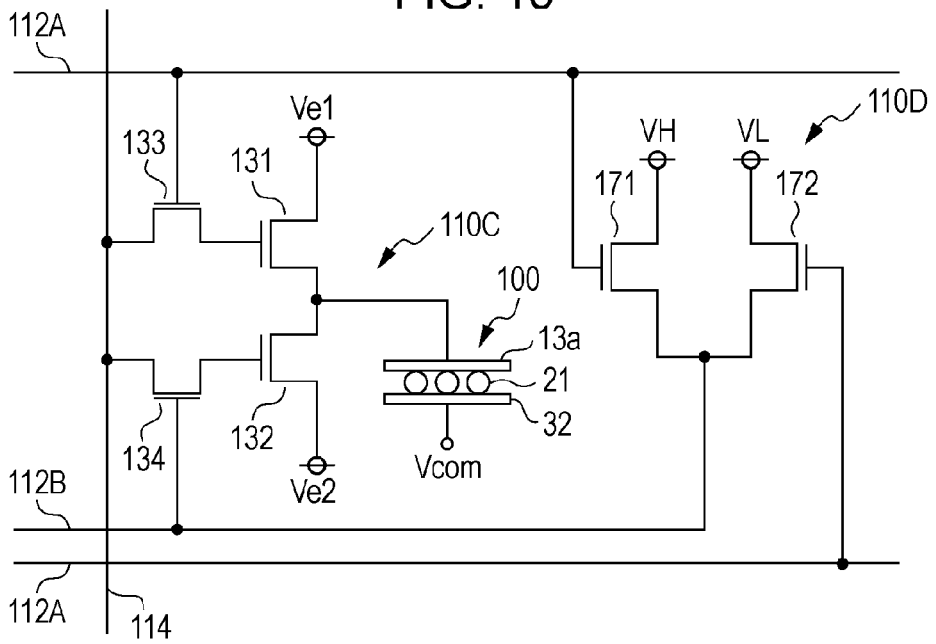
FIG. 15 is a view illustrating the configuration of a pixel circuit according to the modification of the third embodiment.

Next, FIG. 15 is a view illustrating a configuration according to another modification of the third embodiment. Since the configuration of a pixel circuit 110C is the same as the configuration shown in FIG. 13, the description thereof will be omitted. According to the present modification, a TFT 171 (fifth transistor) and a TFT 172 (sixth transistor) are provided for each row of the pixel circuits 110C. The gate of the TFT 171 is connected to a first scan line 112A of a corresponding row, and the gate of the TFT 172 is connected to a first scan line 112A which is selected after the corresponding row has been selected. The drain of the TFT 171 and the drain of the TFT 172 are connected to the second scan line 112B of the corresponding row. A voltage VH is applied to the source of the TFT 171, and a voltage VL is applied to the source of the TFT 172.

Figure 16:
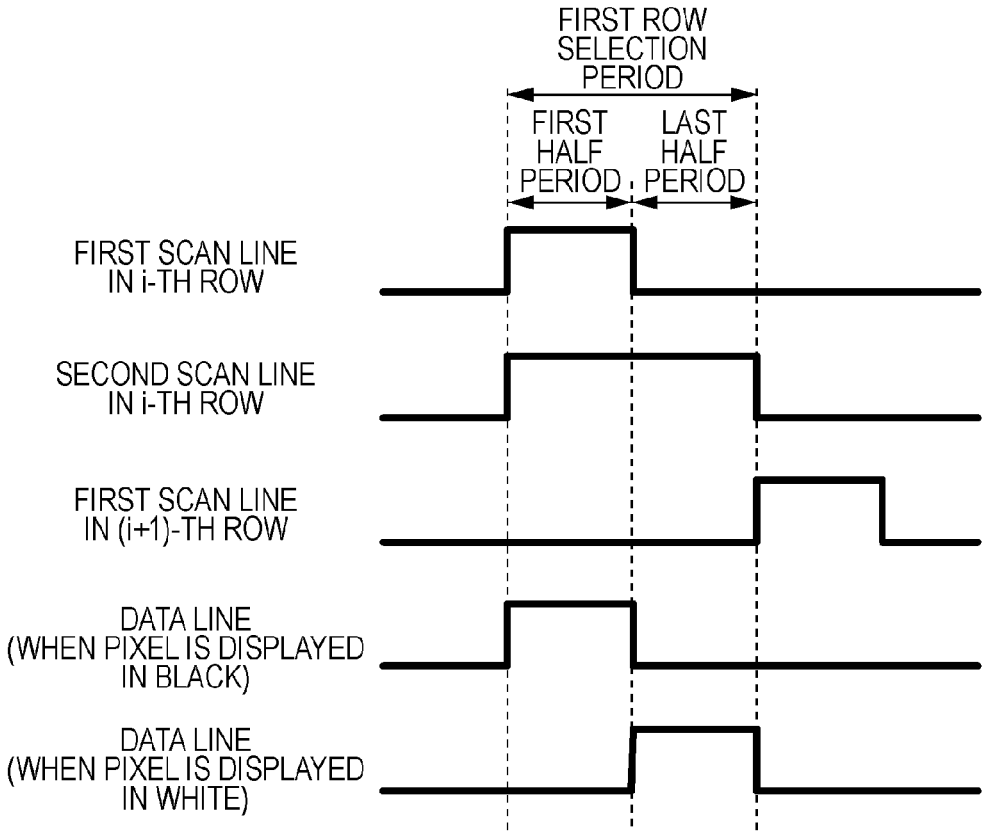
FIG. 16 is a view illustrating signals supplied to respective scan lines and respective data lines according to the modification of the third embodiment.

FIG. 16 is a view illustrating a first row selection period and the waveforms of signals which are supplied to an i-th first scan line 112A, an i-th second scan line 112B, an (i+1)-th first scan line 112A, and a data line 114. The first scan line 112A becomes the H level during the first half of a first row selection period, and then becomes the L level during the last half of the period.

When the first scan line 112A becomes the H level, the TFT 171 is turned on, so that the second scan line 112B becomes the H level. Next, when the first scan line 112A becomes the L level, the TFT 171 is turned off. However, the second scan line 112B maintains the H level using a parasitic capacity. Further, when a subsequent row is selected, that is, when a first scan line 112A in the subsequent row becomes the H level, the TFT 172 is turned on, so that the second scan line 112B becomes the L level. Further, when the first scan line 112A in the subsequent row becomes the L level, the TFT 172 is turned off. However, the second scan line 112B maintains the L level using a parasitic capacity. Therefore, the second scan line 112B becomes the H level during the selection period, and then becomes the L level at the beginning of the subsequent row selection period.

When a pixel 100 which is in the same column as the corresponding data line 114 is displayed in black, the data line 114 becomes the H level during the first half period, and then becomes the L level during the last half period. Further, when the pixel 100 which is in the same column as the corresponding data line 114 is displayed in white, the data line 114 becomes the L level during the first half period, and then becomes the H level during the last half period.

For example, when the pixel 100 is displayed in black, the voltage of the data line 114 is at the H level during the first half selection period, and then is at the L level during the last half selection period. Therefore, since both the TFT 133 and the TFT 134 are turned on during the first half period, the gate of the TFT 131 and the gate of the TFT 132 become the H level. Further, since the TFT 133 is turned off and the TFT 134 is turned on during the last half selection period, the voltage of the gate of the TFT 131 maintains the H level using the parasitic capacity, so that the TFT 131 maintains the turned-on state. Meanwhile, the gate of the TFT 132 becomes the L level. Thereafter, although the TFT 134 is turned off during the subsequent row selection period, the voltage of the gate of the TFT 131 maintains the L level using the parasitic capacity, so that the TFT 131 maintains the turned-off state.

Therefore, the first voltage Ve1 is continuously applied to the pixel electrode 13*a*. If the first voltage Ve1 is continuously applied to the pixel electrode 13*a*, black electrophoretic particles move to the side of a common electrode layer 32, so that the pixel 100 is displayed in black.

Meanwhile, when the pixel 100 is displayed in white, the voltage of the data line 114 is at the L level during the first half selection period, and then is at the H level during the last half selection period. Therefore, since both the TFT 133 and the TFT 134 are turned on during the first half selection period, the gate of the TFT 131 and the gate of the TFT 132 become the L level. Further, since the TFT 133 is turned off and the TFT 134 is turned on during the last half selection period, the voltage of the gate of the TFT 131 maintains the L level using a parasitic capacity, so that the TFT 131 maintains the turned-off state. Meanwhile, the gate of the TFT 132 becomes the H level. Thereafter, the TFT 134 is turned off during a subsequent row selection period. However, the voltage of the gate of the TFT 131 maintains the H level using the parasitic capacity, so that the TFT 131 maintains the turned-on state.

Therefore, the second voltage Ve2 is continuously applied to the pixel electrode 13*a*, so that the pixel 100 maintains a display of white.

According to the present embodiment, voltage is applied to the pixel electrode 13*a* only once when the display of the pixel 100 is changed, so that power consumption can be suppressed. Further, according to the present embodiment, voltage can be differently applied to the pixel electrode 13*a* for each pixel 100, so that a specific one of the pixels 100 in the same row can be changed to be displayed in black and the other pixels can be changed to be displayed in white by selecting the scan line 112 once. Further, according to the present embodiment, memory is not provided for each pixel, so that high-definition may be realized compared to a configuration in which a memory circuit is provided for each pixel.

Electronic Apparatus

Figure 17:
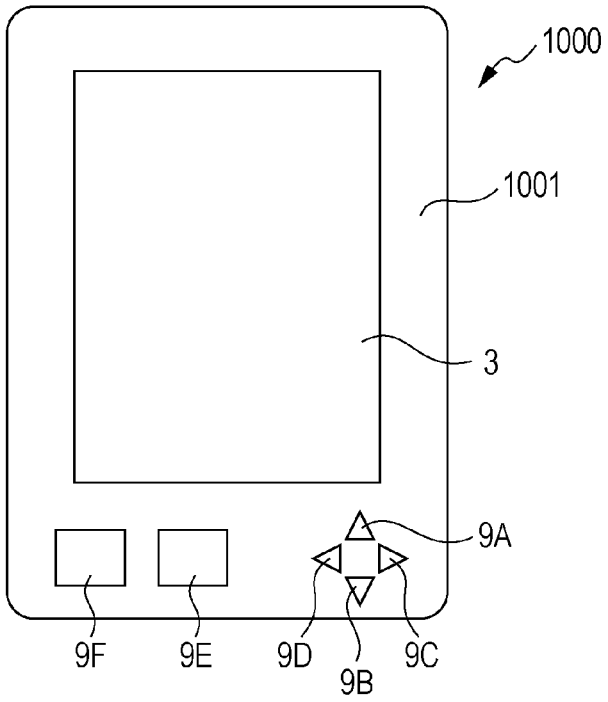
FIG. 17 is a view illustrating the appearance of an electronic apparatus.

Next, an example of an electronic apparatus to which the electro-optical apparatus according to the above-described embodiments or modifications are applied will be described. FIG. 17 is a view illustrating the appearance of an electronic book reader using the corresponding electro-optical apparatus. The electronic book reader 1000 includes a frame 1001 in the form of a plate, buttons 9A to 9F, and the electro-optical apparatus according to the above-described embodiments or modifications. Here, only the display unit 3 of the electro-optical apparatus is exposed in FIG. 17. In the electronic book reader 1000, the contents of the electronic book are displayed on the display unit 3, and the pages of the electronic book are turned over by operating the buttons 9A to 9F.

Further, in addition, a clock, an electronic paper, an electronic notebook, a desktop calculator, or a mobile phone may be given as an example of the electronic apparatus to which the electro-optical apparatus according to the above-described embodiments or modifications may be applied.

Other Modifications

Hereinbefore, although the embodiments of the invention have been described, the invention is not limited to the above-described embodiments and may be implemented according to other various types of embodiments. For example, the invention may be implemented in such a way as to modify the above-described embodiments as below. Further, the above-described embodiments and the modifications below may be combined with each other.

The electro-optical apparatus according to each of the above-described embodiments and each of the modifications is an apparatus made using an electrophoresis method, and corresponds to a micro-capsule method in which the black electrophoretic particles and white electrophoretic particles are enclosed in the micro-capsules 21, and the micro-capsules 21 are arranged between the pixel electrode 13*a* and the common electrode layer 32 which face each other. However, the electro-optical apparatus is not limited to the micro-capsule method. For example, the electro-optical apparatus according to the invention may be made using a horizontal electrophoresis method. Further, the electro-optical apparatus according to the invention may be made using a method which uses electronic powder and granular material (registered trademark) or a charged toner type method.

In the electro-optical apparatus according to the invention, the above-described first voltage Ve1 and second voltage Ve2 are not limited to a specific voltage and may be changed.

The entire disclosure of Japanese Patent Application No. 2011-056527, filed Mar. 15, 2011 is expressly incorporated by reference herein.

What is claimed is:

1. An electro-optical apparatus comprising:

a plurality of pixels, each pixel including:

charged particles between a first electrode and a second electrode; and a pixel circuit, the pixel circuit including:

a scan line;

a data line;

a clock line;

a first transistor, a drain of the first transistor being connected to the first electrode, a predetermined first voltage being applied to a source of the first transistor;

a second transistor, a drain of the second transistor being connected to the first electrode, a predetermined second voltage being applied to a source of the second transistor;

a third transistor, a drain of the third transistor being connected to a gate of the first transistor, a gate of the third transistor being connected to the scan line, a source of the third transistor being connected to the data line; and a fourth transistor, a drain of the fourth transistor being connected to a gate of the second transistor, a gate of the fourth transistor being connected to the clock line, a source of the fourth transistor being connected to the drain of the third transistor;

wherein a state in which the first voltage or the second voltage is applied to the first electrode is made or the first electrode becomes a high impedance state using a signal which is supplied to the gate of the third transistor and the gate of the fourth transistor and using a signal which is supplied to the source of the third transistor and the source of the fourth transistor.

2. The electro-optical apparatus according to claim 1, wherein:

a seventh transistor, an eighth transistor, and a ninth transistor are provided for each row of the pixel circuits;

a gate of the seventh transistor for each row is connected to a scan line corresponding to the corresponding row;

a gate of the eighth transistor for each row is connected to a scan line corresponding to a subsequent row of the corresponding row;

a voltage, used to turn off the ninth transistor, is applied to a source of the seventh transistor;

a voltage, used to turn on the ninth transistor, is applied to a source of the eighth transistor;

a drain of the seventh transistor and a drain of the eighth transistor are connected to a gate of the ninth transistor;

the first voltage is applied to a source of the ninth transistor; and a drain of the ninth transistor is connected to the source of the first transistor.

3. A method for driving an electro-optical apparatus having a plurality of pixels having charged particles between a first electrode and a second electrode, each pixel including a pixel circuit, the pixel circuit including a scan line, a data line, a clock line, a first transistor, a second transistor, a third transistor and a fourth transistor, drains of the first transistor and the second transistor being connected to the first electrode, a gate of the first transistor being connected to a drain of the third transistor, a gate of the second transistor being connected to a drain of the fourth transistor, a gate of the third transistor being connected to the scan line, a source of the third transistor being connected to the data line, a gate of the fourth transistor being connected to the clock line, and a source of the fourth transistor being connected to the drain of the third transistor, the driving method comprising:

applying a predetermined first voltage to a source of the first transistor;

applying a predetermined second voltage to a source of the second transistor;

supplying a signal, used to turn on the third transistor, to a gate of the third transistor during a first period and a second period via the scan line;

supplying a signal, used to turn on the fourth transistor, to a gate of the fourth transistor during a first period via the clock line;

supplying a signal, used to turn off the fourth transistor, to the gate of the fourth transistor during a second period via the clock line; and supplying an image signal, used to define a pixel display state, to the source of the third transistor and the source of the fourth transistor.

4. An apparatus for controlling an electro-optical apparatus having a plurality of pixels having charged particles between a first electrode and a second electrode, each pixel including a pixel circuit, the pixel circuit including a scan line, a data line, a clock line, a first transistor, a second transistor, a third transistor and a fourth transistor, drains of the first transistor and the second transistor being connected to the first electrode, a gate of the first transistor being connected to a drain of the third transistor, a gate of the second transistor being connected to a drain of the fourth transistor, a gate of the third transistor being connected to the scan line, a source of the third transistor being connected to the data line, a gate of the fourth transistor being connected to the clock line, and a source of the fourth transistor being connected to the drain of the third transistor, a predetermined first voltage being applied to a source of the first transistor, a predetermined second voltage being applied to a source of the second transistor, wherein a signal, used to turn on the third transistor, is supplied to a gate of the third transistor during a first period and a second period via the scan line;

wherein a signal, used to turn on the corresponding fourth transistor, is supplied to a gate of the fourth transistor during a first period via the clock line;

wherein a signal, used to turn off the fourth transistor, is supplied to the gate of the fourth transistor during a second period via the clock line; and wherein an image signal, used to define a pixel display state, is supplied to the source of the third transistor and the source of the fourth transistor.

5. An electronic apparatus comprising the electro-optical apparatus according to claim 1.

* * * * *